US007021401B2

(12) United States Patent
Droste et al.

(10) Patent No.: US 7,021,401 B2
(45) Date of Patent: Apr. 4, 2006

(54) HAMMER

(75) Inventors: Manfred Droste, Limburg-Offheim (DE); Martin Soika, Idstein (DE)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 10/493,923

(22) PCT Filed: Oct. 25, 2002

(86) PCT No.: PCT/EP02/11927

§ 371 (c)(1),
(2), (4) Date: Apr. 27, 2004

(87) PCT Pub. No.: WO03/035328

PCT Pub. Date: May 1, 2003

(65) Prior Publication Data

US 2004/0238192 A1 Dec. 2, 2004

(30) Foreign Application Priority Data

Oct. 26, 2001 (GB) ..... 0125749
Jun. 26, 2002 (GB) ..... 0214774

(51) Int. Cl.
*B25D 17/00* (2006.01)

(52) U.S. Cl. ..... 173/109; 173/104; 173/122; 173/212

(58) Field of Classification Search ..... 173/48, 173/104, 109, 122, 212
See application file for complete search history.

(56) References Cited

U.S. PATENT DOCUMENTS 4,280,359 A * 7/1981 Schmid et al. ..... 73/123
5,373,905 A * 12/1994 Bleicher et al. ..... 173/109
5,787,996 A * 8/1998 Funfer ..... 173/104
6,666,284 B1 * 12/2003 Stirm ..... 173/97

* cited by examiner

*Primary Examiner*—Rinaldi I. Rada
*Assistant Examiner*—Nathaniel Chukwurah
(74) *Attorney, Agent, or Firm*—Michael P. Leary; Charles E. Yocum; Adan Ayala

(57) ABSTRACT

An electrically powered hammer comprising a hammer housing (10,15) with a hollow cylindrical spindle (4) mounted within it and an air cushion hammering mechanism mounted within the spindle for generating repeated impacts on a tool or bit of the hammer which hammering mechanism includes a piston (24). A rotatingly driven intermediate shaft (6) is rotatably mounted in the housing and a wobble drive arrangement (12, 16, 18, 20) reciprocatingly drives the piston (24). The wobble drive arrangement includes a wobble sleeve (12) rotatably mounted on the intermediate shaft (6) and a wobble bearing (14, 16, 18) on the wobble sleeve. A support bearing (46, 42) for the intermediate shaft is mounted on the wobble sleeve forwardly of the wobble bearing assembly. The support bearing (46, 42) comprises a bearing ring (46) and the bearing ring is formed with a peripheral flange which can be fixed to a housing part (10) of the hammer housing (10,15).

7 Claims, 2 Drawing Sheets

HAMMER

BACKGROUND OF THE INVENTION

This invention relates to electric hammers, in particular hammers having an air cushion hammering mechanism.

Such hammers will normally have a housing and a hollow cylindrical spindle mounted in the housing. The spindle allows insertion of the shank of a tool or bit, for example a drill bit or a chisel bit, into the front end thereof so that it is retained in the front end of the spindle with a degree of axial movement. The spindle may be a single cylindrical part or may be made of two or more co-axial cylindrical parts, which together form the hammer spindle. For example, a front part of the spindle may be formed as a separate tool holder body for retaining the tool or bit. Such hammers are provided with an impact mechanism which converts the rotational drive from an electric motor to a reciprocating drive causing a piston, which may be a hollow piston, to reciprocate within the spindle. The piston reciprocatingly drives a ram by means of a closed air cushion located between the piston and the ram. The impacts from the ram are transmitted to the tool or bit of the hammer, optionally via a beatpiece.

Such hammers can also be employed in combination impact and drilling mode or in a drilling only mode in which the spindle, or a forwardmost part of the spindle, and hence the bit inserted therein will be caused to rotate. In the combination impact and drilling mode the bit will be caused to rotate at the same time as the bit receives repeated impacts. A rotary drive mechanism transmits rotary drive from the electric motor to the spindle to cause the spindle, or a forwardmost part thereof to rotate.

In smaller hammers, a wobble drive arrangement is generally used to convert a rotary drive from the motor to the reciprocating drive of the piston. In a known arrangement the rotary drive from the motor is transmitted to an intermediate shaft mounted within the hammer housing generally parallel to the axis of the spindle. A wobble sleeve is rotatably mounted on the intermediate shaft. The wobble sleeve is formed with a wobble race which extends around the wobble sleeve at an oblique angle to the axis of the intermediate shaft. Balls are set to run between this inner race and an outer race formed on a wobble ring, which wobble ring has a wobble pin extending from it to the rearward end of the piston. The inner race, outer race and the balls running between the races together form a wobble bearing. The wobble pin is pivotally connected to the rearward end of the piston via a trunnion arrangement. Thus, when the wobble sleeve is rotatably driven the wobble pin reciprocates and reciprocatingly drives the piston within the spindle and hammering occurs. In drilling only mode hammering is not required and so a mode change mechanism is required to selectively transmit the rotation of the intermediate shaft to the wobble sleeve.

In DE35,03,507, U.S. Pat. No. 5,373,905 and EP403,789 intermediate shaft and wobble plate sub-assemblies are shown in which the rearward support bearing for the intermediate shaft is mounted around the wobble sleeve, using the wobble sleeve to form the inner race of the wobble bearing. This has the effect of reducing the number of components, but results in a relatively long combined length for the intermediate shaft and spindle and so is not compact.

In smaller hammers, where the compactness of the hammer is a critical design issue, the intermediate shaft and wobble plate sub-assembly must be compact as well as being robust enough to operate reliably in the high vibration environment of a hammer.

The present invention aims to provide a rotary hammer arrangement with a compact and robust intermediate shaft and wobble sleeve sub-assembly.

Hammer Comprising:

a tool holder located at a forward end of the hammer;

a hammering mechanism for generating repeated impacts on a tool or bit mounted in the tool holder;

a rotatably driven intermediate shaft; and a wobble drive arrangement for reciprocatingly driving the hammering mechanism, which wobble drive arrangement includes a wobble sleeve mounted on the intermediate shaft and a wobble bearing mounted on the wobble sleeve;

characterised in that a support bearing for the intermediate shaft is mounted on the wobble sleeve forwardly of the wobble bearing.

The location of the support bearing nearer to the forward end of the wobble sleeve enables a compact design of intermediate shaft and wobble drive arrangement sub-assembly design with a significant overlap between the axial length of the intermediate shaft and of the spindle. This is partly enabled because the wobble bearing, and thus the wobble drive arrangement may be located further towards the rearward end of the intermediate shaft.

The hammer will generally have a hammer housing with a hollow cylindrical spindle mounted within it and an air cushioning hammering mechanism mounted within the spindle. The hammering mechanism may include a piston, reciprocatingly mounted within the spindle and the wobble drive arrangement may reciprocatingly drive the spindle.

An embodiment of a hammer according to the present invention will now be described by way of example, with reference to the accompanying drawings in which:

Figure 1:
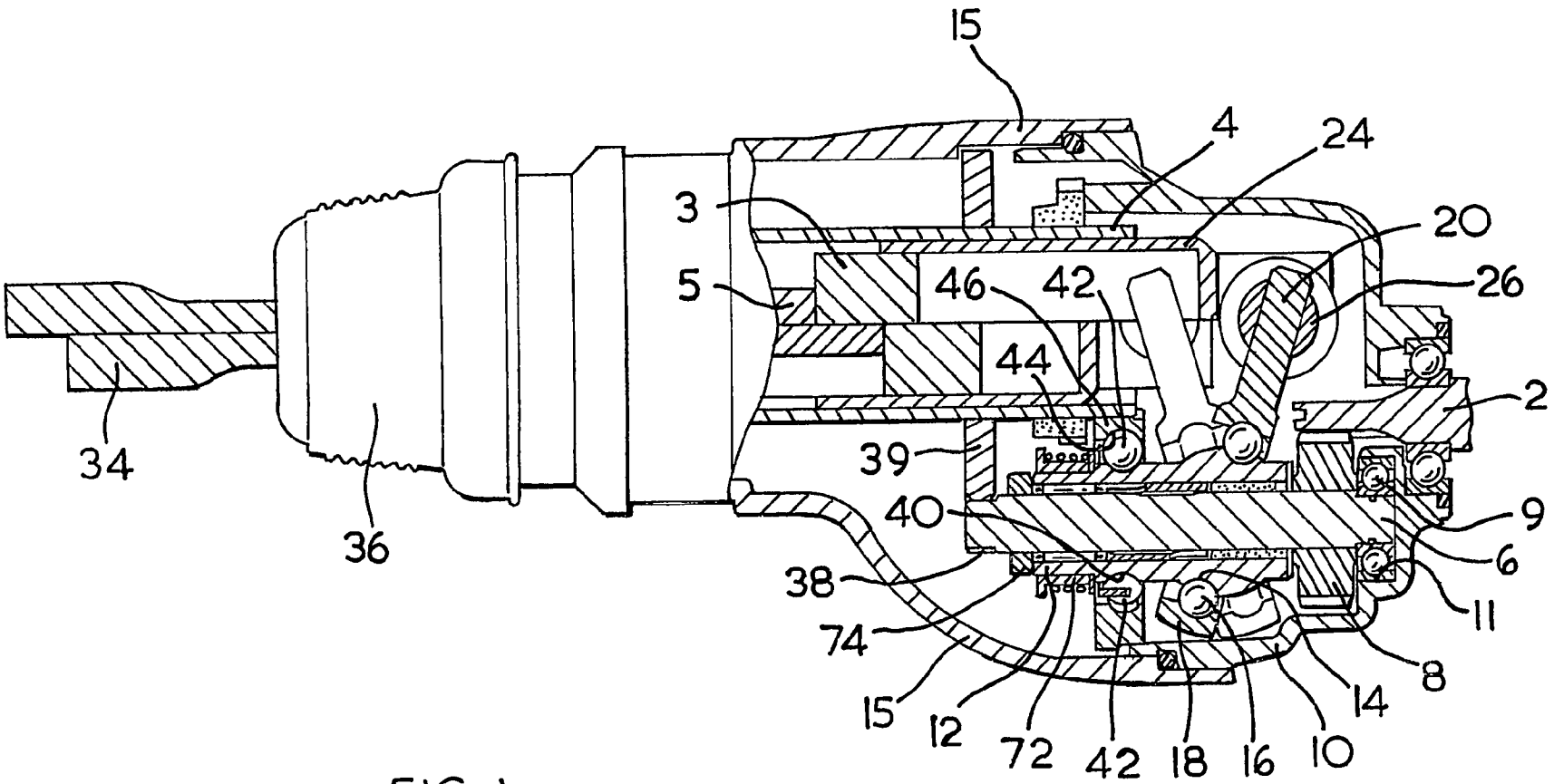
FIG. 1 is a partially cut away side cross-sectional elevation of the forward part of a rotary hammer according to the present invention.

The rotary hammer has a forward portion which is shown in FIG. 1 and a rearward portion incorporating a motor and a rear handle, in the conventional way. The handle may be of the pistol grip or D-handle type. The handle portion incorporates a trigger switch for actuating the electric motor, which motor is formed at the forward end of its armature shaft with a pinion (2). The pinion (2) of the motor rotatingly drives an intermediate shaft (6) via a gear (8) which gear is press fit onto the rearward end of the intermediate shaft (6). The intermediate shaft is mounted within a metal rearward housing part (10) of the hammer, so that it can rotate about it longitudinal axis. The intermediate shaft is mounted in the housing part (10) via a rearward bearing (9) which is press fitted onto the rearward end of the intermediate shaft and is fitted into a receiving recess (11) of the housing part (10). In the FIG. 1 arrangement the longitudinal axis of the motor is parallel with the longitudinal axis of the hollow cylindrical spindle (4) of the hammer. Alternatively, the motor could be aligned with its axis perpendicular to the axis of the spindle (4), in which case a bevel pinion would be formed at the end of the armature shaft of the motor, to mesh with a bevel gear press fit on the intermediate shaft (6) replacing the gear (8).

DETAILED DESCRIPTION OF THE INVENTION

A wobble sleeve (12) is mounted on the intermediate shaft (6) using needle bearings, so that it can rotate with respect to the intermediate shaft. The wobble sleeve (12) carries the inner race (14) for the ball bearings (16) of a wobble ring (18) from which extends a wobble pin (20). The balls are mounted between the inner race (14) and an outer race (22) formed in the wobble ring (18). The inner race (14), outer race (22) and the ball bearings (16) together form a wobble bearing. Thus, as the wobble sleeve (12) rotates the end of the wobble pin (20) remote from the wobble ring (18) is caused to reciprocate, in order to reciprocatingly drive a hollow cylindrical piston (24). The most rearward position of the wobble pin (20) is shown cross-hatched in FIG. 1 and the most forward position of the wobble pin (20) is shown unshaded in FIG. 1. The end of the wobble pin reciprocatingly drives the piston (24) via a trunnion pin arrangement (26), as is well known in the art.

The hollow cylindrical piston (24) is slideably located within the hollow cylindrical spindle (4). A ram (3) is slideably mounted within the hollow cylindrical piston and an O-ring seal is mounted around the ram so as to seal between the periphery of the ram and the internal surface of the piston. During normal operation of the hammer, a closed air cushion is formed between the interior of the piston and the rearward face of the ram and so the ram is reciprocatingly driven by the piston via the closed air cushion. During normal operation of the hammer the ram repeatedly impacts a beapiece (5), which beatpiece is mounted within the spindle so as to be able to undergo limited reciprocation. The beatpiece (5) transfers impacts from the ram to a tool or bit (34) mounted within a forward tool holder portion of the spindle by a tool holder arrangement (36), for example an SDS-type tool holder. The tool or bit (34) is releasably locked within the tool holder portion of the spindle so as to be able to reciprocate within the tool holder portion of the spindle by a limited amount. In FIG. 1 the ram and beatpiece are shown in their idle mode position in the upper half of the spindle (4) and in their operating position in the lower half of the spindle.

The spindle (4) which may be rotatingly mounted within the hammer housing (10, 15) can be rotatingly driven by the intermediate shaft (6), as described below. Thus, as well as or instead of reciprocating, the tool or bit (34) can be rotatingly driven because it is non-rotatably mounted within the spindle (4) by the tool holder arrangement (36). Thus, the hammer may have three modes, a drilling only mode in which no hammering occurs and the spindle is rotatingly driven; a hammer drilling mode in which hammering occurs and the spindle is rotatingly driven and a chisel or hammer only mode in which hammering occurs but there is no rotary drive to the spindle and in which the spindle is generally locked against rotation.

Figure 2:
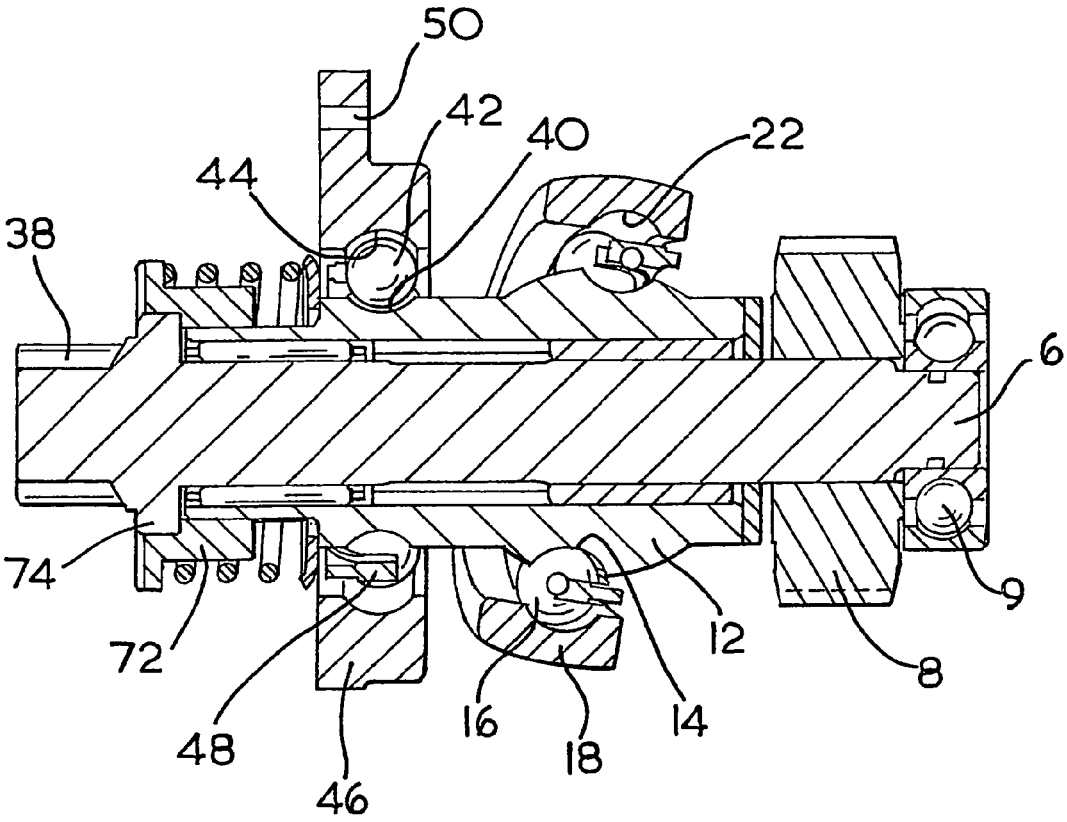
FIG. 2 is a perspective of the intermediate shaft and wobble drive sub-assembly of FIG. 1.

The intermediate shaft (6) is formed at its forward end with a pinion (38) which is selectively engageable with a spindle drive gear (39). A mode change element in the form of a ring (72) is non-rotatably but axially slideably mounted on the forward portion of the wobble sleeve (12), co-axially with the intermediate shaft (6). The mode change ring is mounted on the wobble sleeve via driven teeth, which take the form of two opposing splines formed on the outer surface of the forward end of the wobble sleeve (12). The driven teeth or splines engage in a pair of cooperating recesses which are formed in the radially inward facing surface of the mode change ring. The recesses extend axially from the forward to the rearward facing face of the mode change ring. The recesses of the mode change ring (72) are selectively engageable with an opposing pair of a set of drive teeth (74) formed on an increased outer diameter portion of the intermediate shaft (6). When the mode change ring (72) is in a rearward position, as shown in FIG. 1, no rotary drive is transmitted from the intermediate shaft (6) to the wobble sleeve (12) and so no hammering occurs. When the mode change ring (72) moves forwardly, as shown in FIG. 2, the recesses in the mode change ring (72) engage an opposing pair of the set of drive teeth (74) formed on the intermediate shaft (6). In the forward position of the mode change ring (72) the recesses in the mode change ring straddle the intermediate shaft drive teeth (74) and the splines (76) on the wobble sleeve (12). Thus, in the forward position of the mode change ring (72) rotary drive is transmitted from the intermediate shaft (6) to the wobble sleeve (12) via the mode change ring (72) and hammering occurs.

The wobble sleeve (12) has formed in its external surface, forwardly of the wobble bearing arrangement (14, 16, 18) an annular channel (40) within which run a set of balls (42). The balls run between an inner race formed within the annular channel (40) of the wobble sleeve and an outer race (44) formed in a bearing ring (46). A bearing cage (48) supports the balls (42) as they run between the races (40, 44). The bearing ring (46) is formed with at least two flanges formed with axially extending through holes (50) through which screws are passed in order to secure the bearing ring (46) to the rearward housing part (10).

The bearing ring (46) is used to support the intermediate shaft and wobble plate sub-assembly, within the housing part (10). The intermediate shaft and wobble plate arrangement sub-assembly is shown in FIG. 2. It is pre-assembled and then fitted into the rearward metal housing (10), by pressing the bearing (9) into the receiving recess (11) of the rearward metal housing (10) and by fixing the bearing ring (46) to the metal housing (10). Two screws (not shown) pass through the holes (50) in the flanges of the bearing ring (46) and into corresponding screw bores (not shown) formed in the metal housing (10). Thus, the intermediate shaft (6) is supported in the metal housing (10) by the rearward bearing (9) and the bearing ring (46), via the wobble sleeve (12).

The invention claimed is:

1. An electrically powered hammer comprising:

a hammer housing a tool holder (36) located at a forward end of the hammer;

a hammering mechanism (3, 5, 24) for generating repeated impacts on at tool or bit mounted in the tool holder;

a rotatingly driven intermediate shaft (6); and a wobble drive arrangement (12, 16, 18, 20) for reciprocatingly driving the hammering mechanism (3, 5, 24), which wobble drive arrangement includes a wobble sleeve (12) mounted on the intermediate shaft (6) and a wobble bearing (14, 16, 18) on the wobble sleeve;

characterised in that a support bearing (46, 42) for the intermediate shaft is mounted on the wobble sleeve forwardly of the wobble bearing, the support bearing including a bearing ring (46) and the bearing ring including a flange portion fixed to the hammer housing fixed to a hammer housing (10).

2. A hammer according to claim 1 further comprising a hollow cylindrical spindle (4) mounted within the hammer housing, and an air cushion hammering mechanism.

3. A hammer according to claim 2 wherein the hammering mechanism includes a piston (24) mounted for reciprocation within the spindle and the wobble drive arrangement (12, 16, 18, 20) reciprocatingly drives the piston.

4. A hammer according to claim 1 wherein an inner race (40) for the support bearing (46, 42) is formed in an external surface of the wobble sleeve (12).

5. A hammer according to claim 4 wherein the support bearing ring includes an outer race (44) for bearing balls (42) which run between the inner race and the outer race (40, 44).

6. A hammer according to claim 1 wherein an inner race (14) for the wobble bearing (16, 18) is formed in an external surface of the wobble sleeve (12) rearward of the support bearing (46, 42).

7. A hammer according to claim 1 further comprising a rearward support bearing (9) mounted on the intermediate shaft (6), and fitted into a receiving recess (11) in the hammer housing (10).

* * * * *